US009184007B1

(12) United States Patent
Pileggi et al.

(10) Patent No.: US 9,184,007 B1
(45) Date of Patent: Nov. 10, 2015

(54) MILLIMETER-WAVE ELECTRO-MECHANICAL STRIPLINE SWITCH

(71) Applicant: Tektronix, Inc., Beaverton, OR (US)

(72) Inventors: James D. Pileggi, Beaverton, OR (US); Jason C. Hill, Beaverton, OR (US)

(73) Assignee: TEKTRONIX, INC., Beaverton, OR (US)

( * ) Notice: Subject to any disclaimer, the term of this patent is extended or adjusted under 35 U.S.C. 154(b) by 0 days.

(21) Appl. No.: 14/293,188

(22) Filed: Jun. 2, 2014

(51) Int. Cl.

| | |
|---|---|
| ***H01P 1/10*** | (2006.01) |
| ***H01H 50/00*** | (2006.01) |
| ***H01H 15/00*** | (2006.01) |
| ***H01H 51/01*** | (2006.01) |
| ***H01P 1/12*** | (2006.01) |
| ***H01H 51/22*** | (2006.01) |
| ***H01H 51/27*** | (2006.01) |
| *H01H 36/00* | (2006.01) |
| *H01H 1/00* | (2006.01) |

(52) U.S. Cl.
CPC ..... *H01H 50/005* (2013.01); *H01H 15/005* (2013.01); *H01H 51/01* (2013.01); *H01H 51/2227* (2013.01); *H01H 51/27* (2013.01); *H01P 1/127* (2013.01); *H01H 2001/0042* (2013.01); *H01H 2036/0093* (2013.01); *H01H 2050/007* (2013.01)

(58) Field of Classification Search
CPC ..... H01P 1/10–1/127; H01H 1/0036; H01H 50/005; H01H 2050/007; H01H 2001/0042; H01H 15/005; H01H 2036/0093; H01H 51/01; H01H 51/2227; H01H 51/27
USPC ..... 333/105–108, 262; 335/4
See application file for complete search history.

(56) References Cited

U.S. PATENT DOCUMENTS

| | | | | |
|---|---|---|---|---|
| 4,839,619 | A * | 6/1989 | Mutton | 335/125 |
| 2012/0013425 | A1 * | 1/2012 | Tor et al. | 335/256 |

* cited by examiner

*Primary Examiner* — Ramon Barrera
(74) *Attorney, Agent, or Firm* — Michael A. Nelson; Marger Johnson

(57) ABSTRACT

An electromechanical microswitch, comprising first and second electromagnets mounted in spaced-apart orientation to one another where each electromagnetic has a field center located a first distance above the mounting surface. A permanent magnet is positioned between the electromagnets and includes a magnetic field center that is higher above the mounting surface than that of the electromagnets so that the permanent magnet is magnetically biased toward the mounting surface. A stripline switch element is mountable between the permanent magnet and mounting surface, and biased against circuit structures on the mounting surface, whereby the stripline switch element moves between first and second activated positions under influence of the electromagnets.

20 Claims, 6 Drawing Sheets

MILLIMETER-WAVE ELECTRO-MECHANICAL STRIPLINE SWITCH

BACKGROUND

This invention relates to microswitches and, more particularly, to electro-mechanical stripline switches mountable to a circuit board.

Switches have long been used in electrical circuit designs to isolate a portion of an electrical circuit. In its simplest form, a switch operates to allow a signal to pass from an input terminal to an output terminal in a "closed" position and to prevent the signal from passing from the input terminal to the output terminal in an "open" position. Other such switches, such as those having a single pole dual throw (SPDT), switch between contacts for different functions.

Micro-electromechanical systems (MEMS) are electromechanical devices that generally range in size from a micrometer to a millimeter in a miniature sealed package. In the microwave and mm-wave frequency range, switches are used in instrumentation, communications, radar, fiber optic and many other systems that require high-frequency switching. For example, a switch can be used for pulse modulation, port isolation, transfer switching, high-speed switching, replacement of mechanical parts and other switch applications.

A MEMS device in the form of a microswitch has a movable actuator, sometimes referred to as a movable electrode, that is moved toward a stationary electrical contact by the influence of a gate driver (also referred to as a gate or substrate electrode) positioned on a substrate below the movable actuator. The movable actuator may be a flexible beam that bends under applied forces such as electrostatic attraction, magnetic attraction and repulsion, or thermally induced differential expansion, that closes a gap between a free end of the beam and the stationary contact. If a large enough differential voltage exists between the free end of the beam and the stationary electrical contact, a resulting electrostatic force can cause the beam to self-actuate without any gating signal being provided by a gate driver. In certain current switching applications, this self-actuation can result in catastrophic failure of the switch or downstream systems.

There a number of commercially available high-frequency switches on the market today. Unfortunately, most or all of these switches require trade-offs on performance as they are unable to operate within all desired features simultaneously including obtaining high switch isolation greater than 15 dBm, high power handling above 24 dBm, and low insertion loss of a fraction of a dB from DC to mm-wave frequencies. For example, high-frequency switches employing field-effect transistors (FETs) typically are unable to handle high frequencies in the mm-wave range and/or high power above 24 dBm. In the alternative, FET-based solutions may have high insertion loss. In addition, waveguide-based switches are difficult to integrate and lack the required bandwidth coverage to DC. Furthermore, coupling-based diplexers typically have poor isolation and high insertion loss at the cross-over frequency.

In the field particular to analyzer and scope attenuators, millimeter wave microswitches are desired that are hot-switchable +30 dBm, have a high durability (e.g. rated at 10 million cycles), and are capable of being mountable to a circuit board. However, there is a lack of hot-switchable, small, circuit board mountable switches on the market. Existing millimeter wave switches are large, connectorized assemblies that are not easily gang-assembled to a circuit board.

Such existing millimeter switches would be difficult, for instance, to use with a Spectrum Analyzer attenuator with 70 dB of dynamic range where 16 SPDT switches may be required.

Accordingly, the need remains for millimeter wave switches that overcome the drawbacks of the existing art while providing functions useful for today's modern equipment.

SUMMARY OF THE INVENTION

A microswitch constructed according to teachings of the invention include first and second electromagnets mounted in spaced-apart orientation to one another on a mounting surface to define a sliding volume between them. The first and second electromagnets each having an electromagnetic field center located a first distance above the mounting surface. A stripline switch element is mounted to a surface substantially between the first and second electromagnets. The stripline switch includes a fixed portion having an aperture defining a sliding boundary between the first and second electromagnets and a sliding portion received within the aperture for lineal movement between first and second activated positions. The sliding portion includes a facing portion directed toward the mounting surface and an opposing surface facing out of the aperture. A permanent magnet is coupled to the opposing surface of the sliding portion and mounted within the sliding volume between the first and second electromagnets. The permanent magnet has a magnetic field center located a second distance above the mounting surface, with the second distance being greater that the first distance so that the permanent magnet is biased toward the mounting surface.

In use, the electromechanical microswitch includes surface electrical contacts formed on the mounting surface and facing surface electrical contacts formed on the facing surface of the stripline switch element sliding portion. The facing surface electrical contacts are configured to effect electrical contact with different portions of the mounting surface electrical contacts depending upon whether the stripline switch element is in either the first or second activated position.

The invention also includes a method for switching between first and second circuit paths using a micromechanical switch. The method comprises magnetically clamping a sliding waveguide circuit to a fixed waveguide circuit to make a stripline waveguide having a first circuit path when the sliding waveguide circuit is in a first activated position with respect to the fixed waveguide circuit, and a second circuit path when the sliding waveguide circuit is in a second activated position. Two magnetic paths are applied to the sliding waveguide circuit, whereby the reluctance of the magnetic paths are changed to move the sliding waveguide circuit between the first and second activated positions.

The foregoing and other objects, features and advantages of the invention will become more readily apparent from the following detailed description of a preferred embodiment of the invention that proceeds with reference to the accompanying drawings.

DETAILED DESCRIPTION

Figure 1:
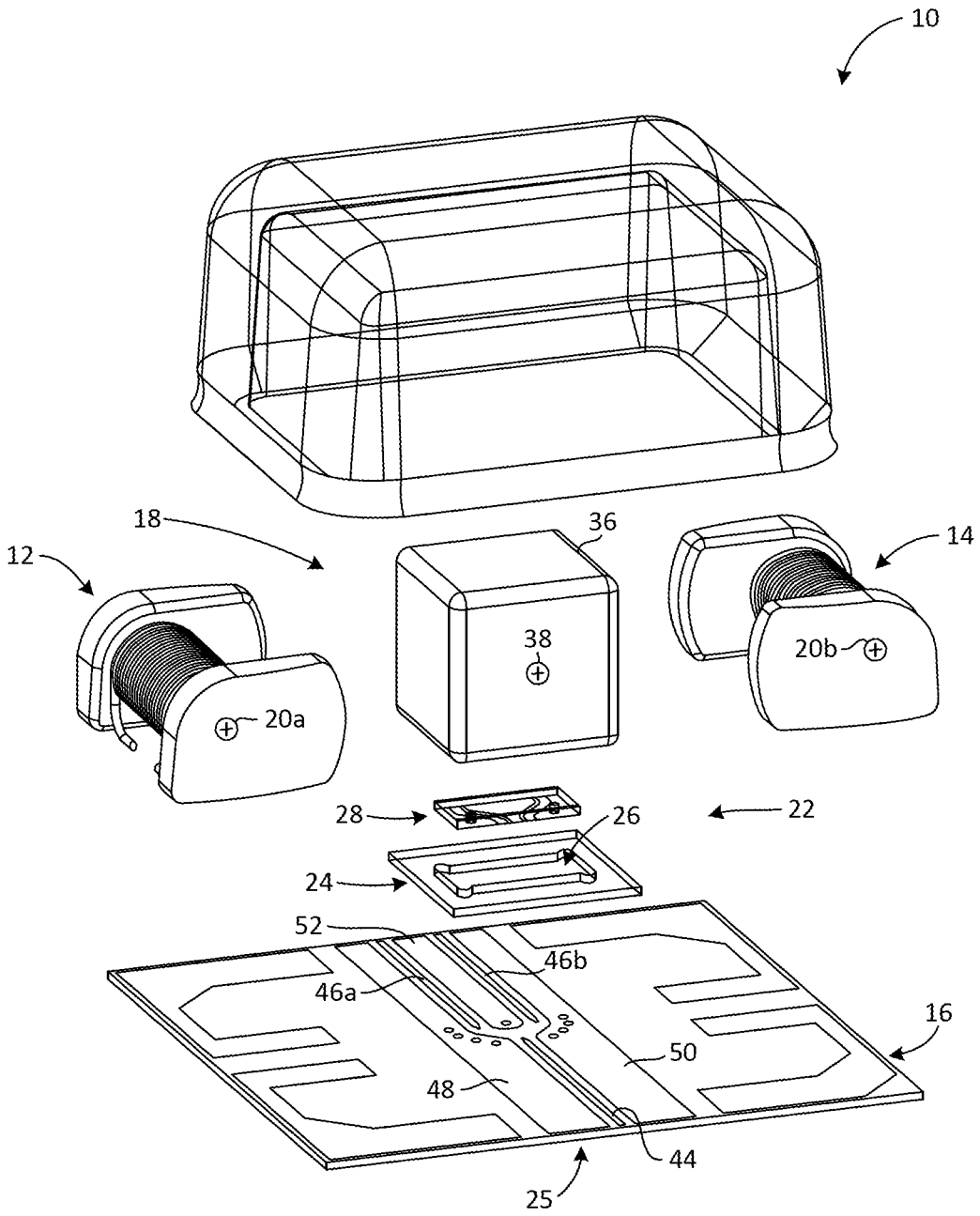
FIG. 1 is an exploded perspective view of a microswitch constructed according to a preferred embodiment of the invention.

FIG. 1 is an exploded view of the microswitch 10 constructed according to embodiments of the invention. Microswitch 10 includes first and second electromagnets 12, 14 mounted in spaced-apart orientation to one another on a mounting surface—here, thin film substrate 16—to define a sliding volume 18 [see, e.g., FIG. 6] between them. The first and second electromagnets 12, 14 each have an electromagnetic field center 20*a*, 20*b* located a first distance $D_1$ above the mounting surface/substrate 16 [see FIG. 6]. A stripline switch element 22 is mounted to a surface substantially between the first and second electromagnets 12, 14.

The stripline switch includes a fixed portion 25 between the first and second electromagnets 12, 14 and a sliding portion 28 positioned in contact with the fixed portion 25. A window 24 is affixed to the fixed portion 25 of the switch 22 and includes a sliding boundary aperture 26 formed therethrough. The aperture opening 26 length is sized larger than the length of the sliding portion 28 of the stripline switch element 22 so that the sliding portion moves along a sliding axis between activated positions between the first and second electromagnets. The aperture opening 26 width is sized to be substantially similar to the width of the sliding portion so that movement of the sliding portion 28 is confined between activated positions only along the sliding axis. When received within the sliding boundary aperture 26 of window 24, the sliding portion 28 of stripline switch element moves left-right between the first and second electromagnets 12, 14 between activated positions as described below. The sliding portion 28 thus moves in relation to the fixed portion 25 of the stripline switch element 22 and along the sliding axis within a sliding boundary created within the sliding boundary aperture 26. This results in lineal movement 30 [see FIG. 3] between first and second activated positions.

Figure 2:
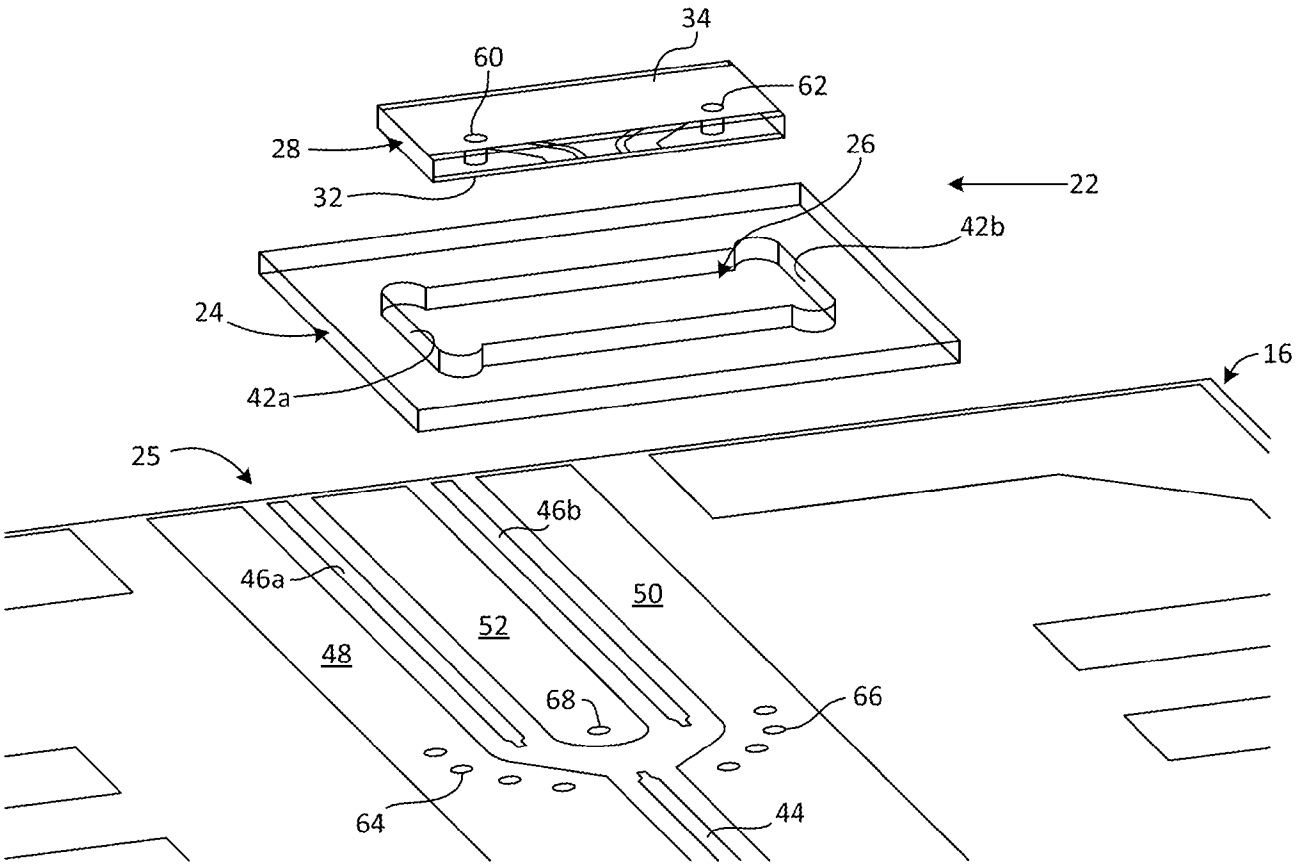
FIG. 2 is an exploded perspective view showing the stripline switch portion of the microswitch of FIG. 1.

The sliding portion 28 includes a facing portion 32 [see FIG. 2] directed toward the mounting surface 16 and an opposing surface 34 facing out of the aperture 26. A permanent magnet 36 is coupled to the opposing surface 34 of the sliding portion 28 and mounted within the sliding volume 18 between the first and second electromagnets 12, 14. The permanent magnet 36 has a magnetic field center 38 located a second distance $D_2$ above the mounting surface, with the second distance $D_2$ being greater that the first distance $D_1$ [see FIG. 6] so that the permanent magnet 36 is biased 40 toward the mounting surface 16.

FIG. 2 illustrates a magnified portion of FIG. 1 focusing on the stripline switch element 22 of the microswitch 10 of FIG. 1. As explained above, the sliding portion 28 of stripline switch element 22 is retained within an aperture 26 and the aperture formed within a window 24 coupled to the fixed switch portion 25. The aperture is sized larger than the sliding portion along a sliding axis between electromagnets 12, 14 so that the sliding portion 28 moves within the aperture 26 between retaining ends 42*a*, 42*b*. The sliding portion 28 including electrical contacts formed on an underside 32 of the sliding portion 28 that are adapted to directly contact complementary contacts formed on the mounting surface 16. When such contacts are constructed as a grounded coplanar waveguide (GCPW), the exemplary contacts on the mounting surface 16 include signal traces comprising an input conductor 44 and alternate output conductors 46*a*, 46*b*, each separated from a pair of groundplanes—e.g. input conductor 44 separated from groundplanes 48 and 50, output conductor 46*a* separated from groundplanes 48 and 52, and output conductor 46*b* separated from groundplanes 50 and 52. At least a portion of these complementary contacts on mounting surface 16—including conductors 44, 46*a*, and 46*b*, and groundplanes 48, 50, and 52—are exposed for contact through the aperture 26.

Figure 3:
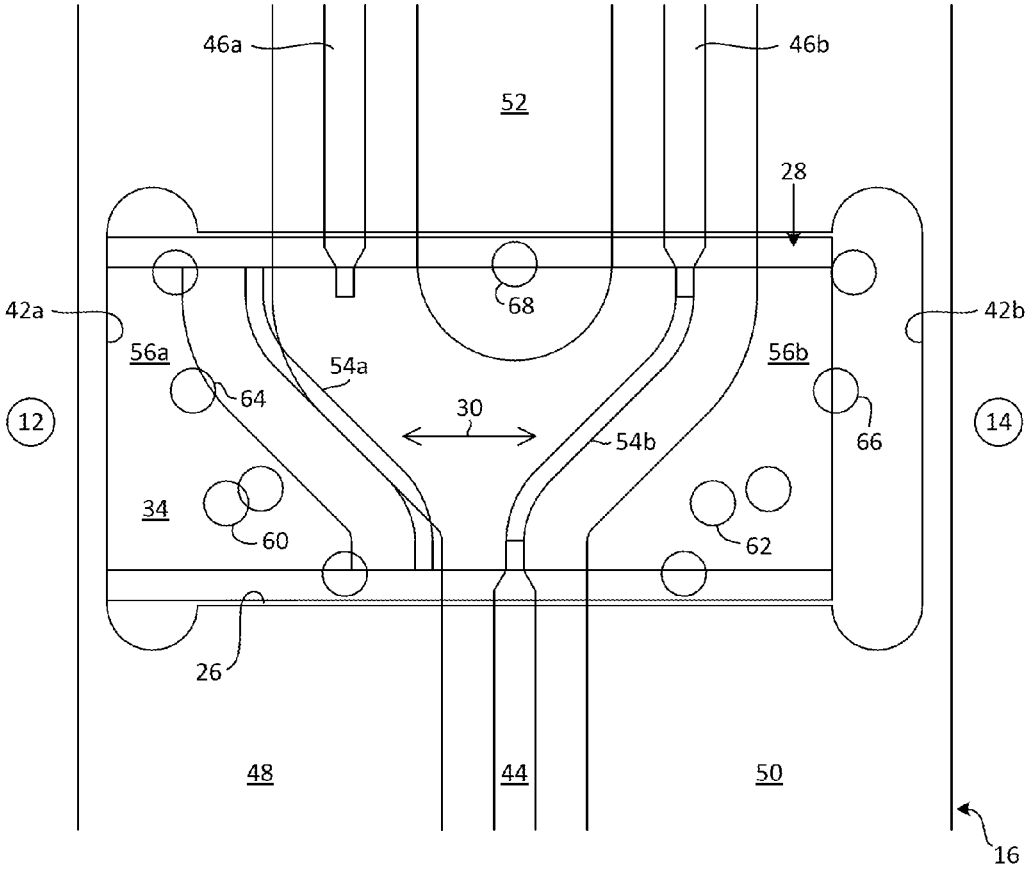
FIG. 3 is a top plan view of the stripline switch portion of the microswitch shown in a first activated position.

FIG. 3 illustrates a top plan view of stripline switch element 22 of the microswitch 10 in a second of two activated positions. As explained above, the sliding portion 28 of stripline switch element 22 is retained within an aperture 26 formed through window 24 that itself is coupled to the fixed portion 25 of the switch 22, where the aperture is sized larger than the sliding portion along a sliding axis between electromagnets 12, 14 so that the sliding portion 28 moves east-west between retaining ends 42*a*, 42*b* while remaining relatively fixed from sliding north-south in a perpendicular axis.

The facing surface 32—that is, the surface facing downward within aperture 26 and against the fixed switch portion 25—includes facing surface electrical contacts 54*a*, 54*b* configured to effect electrical contact with different portions of the mounting surface electrical contacts, e.g. either signal trace 46*a* or 46*b*, depending upon whether the sliding portion 28 of the stripline switch element 22 is in the first or second activated position. Signal traces 54*a*, 54*b* are spaced apart a distance that is different than the spacing between fixed switch traces 46*a*, 46*b* so that only one signal path is active at one time no matter how the sliding portion 28 is positioned within the aperture 26.

The underside 32 of the sliding portion 28 of switch element 22 includes electrical contacts forming at least two switch paths—including a first switch path 54*a* and a second switch path 54*b* running somewhat perpendicular to the direction movement 30 of the sliding portion 28. The mounting surface 16 electrical contacts include first and second throw paths between fixed stripline switch elements 44 and 46*a* or 46*b*. The facing surface 32 electrical contacts include a first slider switch element 54*a* effecting electrical continuity along the first throw path—e.g. between elements 44 and 46*a*—when the sliding portion is in the first activated position. The facing surface 32 further includes a second slider switch element 54*b* effecting electrical continuity along the second throw path—e.g. between elements 44 and 46*b*—when the sliding portion is in the second activated position.

In FIG. 3, the sliding portion 28 is shown moved within aperture 26 completely to the left and against boundary 42*a* so that the switch is in the second of two activated positions. In the second activated position, second switch path 54*b* formed on the underside 32 of the sliding portion couples between input conductor 44 and second output conductor 46*b*. Alternately, when the sliding portion 28 is moved to the right against boundary 42*b*, then the switch is in the first activated position, that is where the first switch path 54*a* formed on the underside 32 of the sliding portion 28 couples between input conductor 44 and first output conductor 46*a*. In either of these two activated positions, where only a single switch path is activated, and throughout movement of the stripline switch element sliding portion 28 between the first and second activated positions, the ground contact pads 56*a*, 56*b* formed on the facing surface 32 of the sliding switch portion 28 are in continuous contact with complementary ground contact pads 48, 50 formed on the substrate 16. These ground contact pads 56*a*, 56*b* are each formed on peripheral expanses of the facing surface 32 adjacent the first and second electromagnets 12, 14, wherein the first and second slider traces 54*a*, 54*b* are positioned between the ground contact pads 56*a*, 56*b*. Because the resulting circuit has a lightly coupled coplanar structure, grounds 56*a* and 56*b* are preferably positioned in close proximity to signal traces 54*a*, 54*b*.

It has been found that always maintaining ground pad contact greatly improves RF isolation between switch paths. The primary function of the continuous ground contact is to provide an unvarying ground reference to the conducting medium. This creates a controlled impedance environment thereby reducing signal reflections caused by impedance mismatch. The secondary function of the continuous ground contact is to reduce the chance that the signal trace will catch on its mating trace during sliding by maintaining the planarity of the sliding structure.

Stripline switch 22 includes backside ground structures including a ground plane formed on opposing surface 34 of the sliding portion 28 and the opposing surface of the substrate 16. Vias 60, 62 formed between the facing surface 32 and opposing surface 34 of the sliding portion 28 connect the front (e.g. contact side) ground to the backside ground—e.g. via 60 connecting frontside ground 56*a* to the ground formed on opposing surface 34, and via 62 connecting frontside ground 56*b* to the backside ground on opposing surface 34.

Vias are also formed between frontside (e.g. contact) ground structures on the substrate 16 and those on its backside (not shown). Via 64 is part of a pattern of such vias spaced along groundplane 48. Via 66 is part of a similar pattern of such vias spaced along groundplane 50. Finally, the structure includes a via 68 coupling groundplane 52 with the backside ground formed on the opposite side of the substrate 16.

An advantage of forming the switch as a coplanar waveguide is that active devices can be mounted on top of the circuit or microstrip. More importantly, it can provide extremely high frequency response (100 GHz or more) since connecting to CPW does not entail any parasitic discontinuities in the ground plane.

The microswitch 10 is preferably formed using specified materials to effect durability of the device. The fixed portion window 24 and the sliding portion 28 of the stripline switch element 22 each preferably include sapphire wear surfaces in sliding contact with one another. Furthermore, all contracts are preferably made from refractory metals that are extraordinarily resistant to heat and wear. Examples of such metals include Niobium (Nb), Molybdenum (Mo), Tantalum (Ta), Tungsten (W), Rhenium (Re), Titanium (Ti), Vanadium (V), Chromium (Cr), Zirconium (Zr), Ruthenium (Ru), Rhodium (Rh), Hafnium (Hf), Osmium (Os), and Iridium (Ir) and their respective alloys. Most preferably, all contacts are made from the following subgroup of refractory metals and their alloys, including Niobium (Nb), Molybdenum (Mo), Tantalum (Ta), Tungsten (W), and Rhenium (Re). Most preferably, the contacts are made from Rhodium (Rh) or Platinum (Pt). These metals having similar properties of durability, including a melting point above 2000° C. and high hardness at room temperature. They are chemically inert and have a relatively high density, and their high melting points make powder metallurgy the method of choice for fabricating components from these metals.

Figure 4:
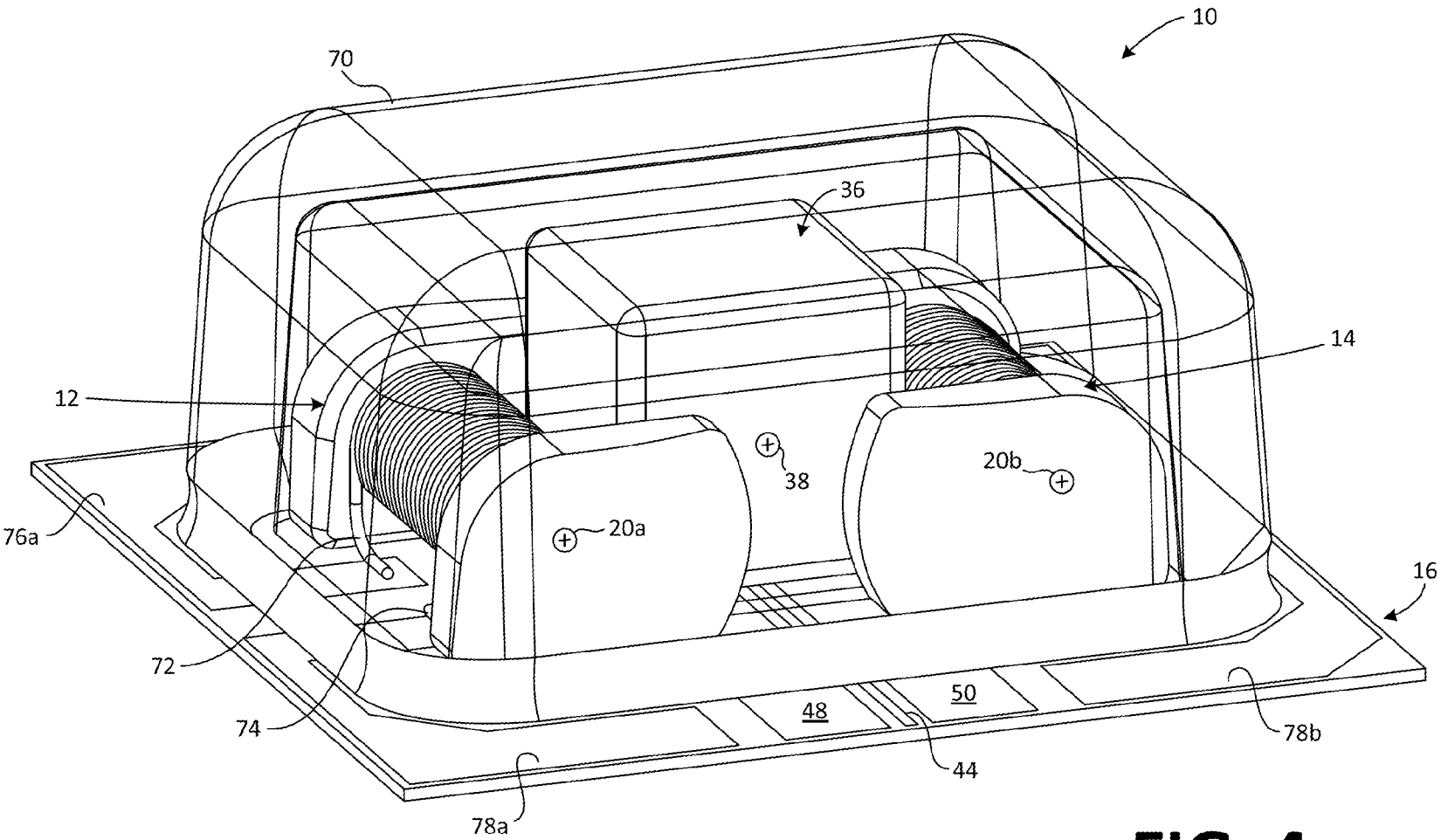
FIG. 4 is an assembled perspective view of the microswitch of FIG. 1.

FIG. 4 illustrates the assembled microswitch 10 encapsulated within hermetic enclosure 70. Hermetic enclosure 70 is preferably formed of glass or a like material and seals to substrate 16 about the periphery of the fixed switch element 25. The sealing of the switch 22 within the hermetic enclosure 70 has been found to increase the longevity of any moving contact switch and to reduce the contamination of the switch in the areas of contact. Having large contact areas in non-hermetic switches can help increase their lifetime but also has been found to significantly limit how high a frequency they can pass. With small contact areas such as in the present switch 22, small particles have more effect and external contamination can be more problematic thus making the sealing of the switch within a hermetic enclosure more preferred.

Electromagnet 12 is coupled via wires 72, 74 to driving circuit traces 76*a*, 78*a* formed on substrate 16 to energize and drive the polarity of the electromagnet 12. Electromagnet 14 is similarly configured to couple via wires (not shown) to driving circuit traces 76*b*, 78*b*. In operation, the sliding waveguide circuit 28 is magnetically clamped to the fixed waveguide circuit 25 formed on substrate 16 to make a stripline waveguide having a first circuit path—e.g. along fixed trace 44, sliding contact 54*a*, and fixed trace 46*a*—when the sliding waveguide circuit 28 is in a first activated position with respect to the fixed waveguide circuit, and a second circuit path—e.g. along fixed trace 44, sliding contact 54*b*, and fixed trace 46*b*—when the sliding waveguide circuit 28 is in a second activated position [see, e.g. FIG. 3]. Two magnetic paths, one from each of the electromagnets 12, 14, are applied to the sliding waveguide circuit 28 and the reluctance of both magnetic paths changed to move the sliding waveguide circuit 28 between the first and second activated positions.

Figure 5:
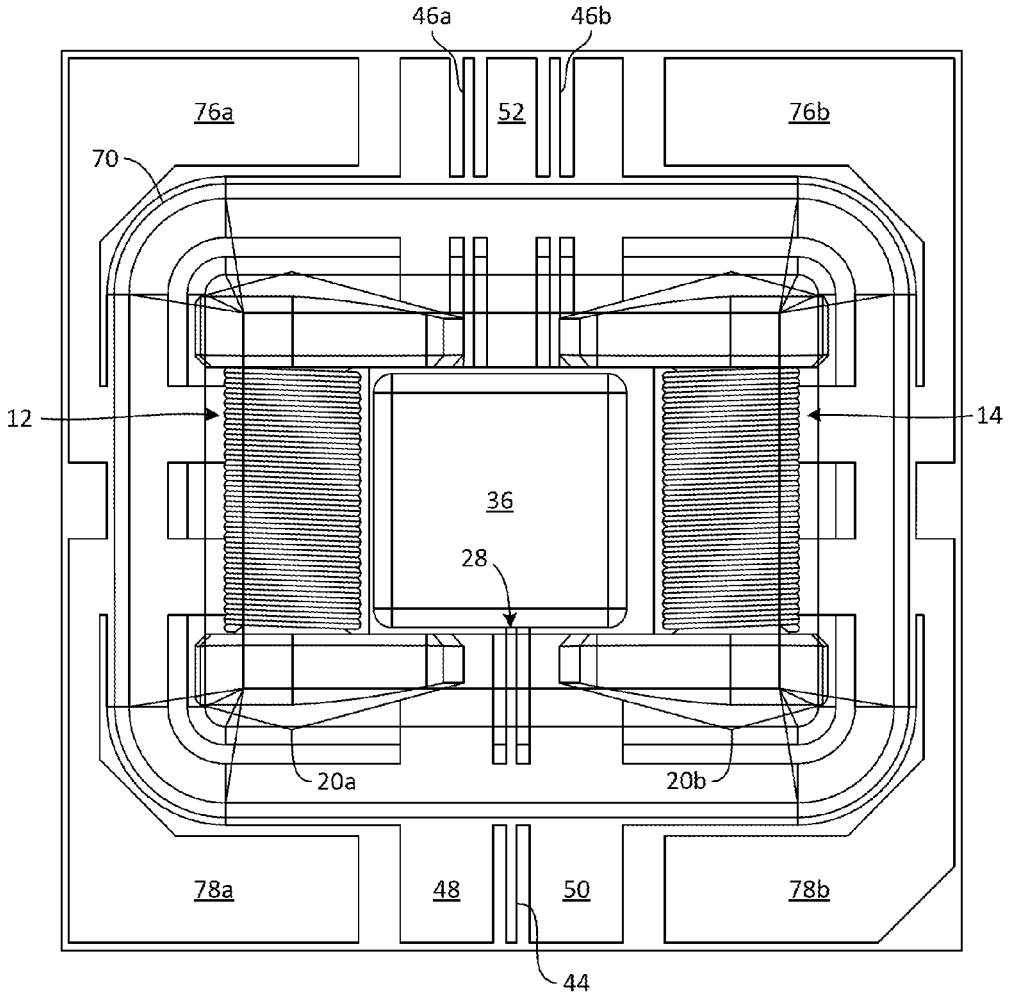
FIG. 5 is a top plan view of the microswitch of FIG. 4.
Figure 6:
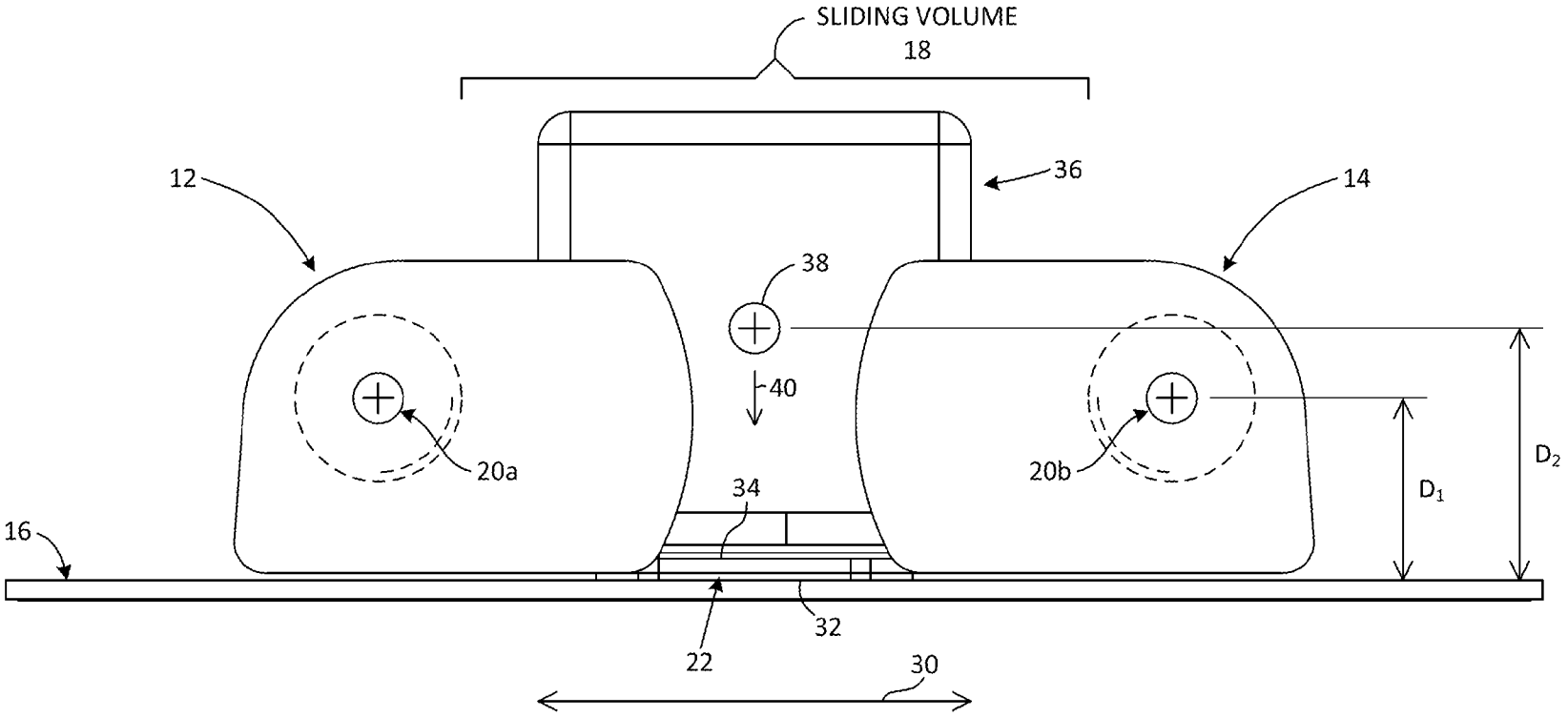
FIG. 6 is a side elevation view of the microswitch of FIG. 4 with the hermetic enclosure removed.

As shown in FIGS. 4-6, electromagnets 12, 14 are spaced to either side of the sliding waveguide circuit 28 so that the electromagnetic field centers 20*a*, 20*b* of electromagnets 12, 14 are located a first distance $D_1$ above the mounting surface 16. The permanent magnet 36 is coupled to the sliding waveguide circuit 28 and between the first and second electromagnets 12, 14 so that a magnetic field center 38 of the permanent magnet is located a second distance $D_2$ above the mounting surface 16, with the second distance $D_2$ being greater than the first distance $D_1$ so that the permanent magnet is biased toward the fixed waveguide circuit 25.

The step of changing the reluctance of both magnetic paths includes switching voltage polarities of the electromagnets 12, 14 to thereby reduce a magnetic resistance equivalent adjacent the first activated position and increase a magnetic resistance equivalent adjacent the second activated position so that a net magnetic force moves the permanent magnet 36 and coupled sliding waveguide circuit 28 to the first activated position. To switch the circuit to the second activated position, the polarities driving the electromagnets can be switched, as via driving contacts 76*a*, 78*a* and 76*b*, 78*b*, to thereby reduce the magnetic resistance equivalent adjacent the second activated position and increase a magnetic resistance equivalent adjacent the first activated position so that a net magnetic force moves the permanent magnet 36 and coupled sliding waveguide circuit 28 to the second activated position. While the field of the electromagnets does not overwhelm the permanent magnetic field of the permanent magnet 36, it does reduce the reluctance of the magnetic path on the side that the permanent magnet is desired to move to. It also increases the reluctance of the opposite side path so that less magnetic flux flows in that path. The result is a net magnetic force pulling and pushing the magnet 36 into position with the path of least reluctance.

It has been found that electromagnets 12, 14 need not be continuously energized. Instead, once the magnet 36 has moved to the loss reluctance side, it will stay there due to residual magnetic fields and the lower maintained reluctance on that side. The electromagnets may be pulse-energized, that is switched on and then off with a switched polarity, to effect movement of the switch to the opposite (e.g. second) activation position. The electromagnets may be pulse-energized a second time with a differently switched polarity to again move the switch to the first activation position. If additional holding strength is required due to harsh vibrational environments, then the power to the electromagnets can be left on, which will increase the magnetic forces holding the sliding circuit 28 in place.

One advantage of the switch described is that it can be hot-switchable, meaning attenuation can be changed on the fly without powering down the system and thereby allowing test data to be read continuously. Other advantages result from the apparatus having a stripline structure to provide better high frequency performance and RF isolation between switch positions while using a variable magnetic reluctance circuit for moving the elements of the stripline switch between positions.

Although particular embodiments have been described, it will be appreciated that the principles of the invention are not limited to those embodiments. Variations and modifications may be made without departing from the principles of the invention as set forth in the following claims.

The invention claimed is:

1. An electromechanical microswitch, comprising:

first and second electromagnets mounted in spaced-apart orientation to one another on a mounting surface and defining a sliding volume between them, said first and second electromagnets each having an electromagnetic field center located a first distance above the mounting surface;

a stripline switch element mountable to a surface substantially between the first and second electromagnets, said stripline switch including a fixed portion having an aperture defining a sliding boundary between the first and second electromagnets and a sliding portion received within the aperture for lineal movement between first and second activated positions, with said sliding portion including a facing portion directed toward the mounting surface and an opposing surface facing out of the aperture; and a permanent magnet coupled to the opposing surface of the sliding portion and mounted within the sliding volume between the first and second electromagnets, said permanent magnet having a magnetic field center located a second distance above the mounting surface, with the second distance being greater that the first distance so that the permanent magnet is biased toward the mounting surface.

2. The electromechanical microswitch of claim 1, wherein the aperture is formed through a window coupled to the stripline switch element fixed portion to expose the mounting surface, said sliding portion including electrical contacts formed on an underside of the sliding portion and adapted to directly contact complementary contacts formed on the mounting surface.

3. The electromechanical microswitch of claim 1, further including:

mounting surface electrical contacts formed on the mounting surface; and facing surface electrical contacts formed on the facing surface of the stripline switch element sliding portion, wherein the facing surface electrical contacts are configured to effect electrical contact with different portions of the mounting surface electrical contacts depending upon whether the stripline switch element is in either the first or second activated position.

4. The electromechanical microswitch of claim 3, wherein the mounting surface electrical contacts include first and second throw paths between fixed stripline switch elements, the facing surface electrical contacts including:

a first slider switch element effecting electrical continuity along the first throw path when the sliding portion is in the first activated position; and a second slider switch element effecting electrical continuity along the second throw path when the sliding portion is in the second activated position.

5. The electromechanical microswitch of claim 4, further including sliding ground contact pads each formed on a peripheral expanse of the facing surface adjacent respective first and second electromagnets, wherein the first and second slider switches are positioned between the ground contact pads.

6. The electromechanical microswitch of claim 3, the facing surface electrical contacts further including sliding ground contact pads configured to be in constant contact with mounting surface ground contacts throughout movement of the stripline switch element sliding portion between the first and second activated positions.

7. The electromechanical microswitch of claim 6, wherein the sliding ground contact pads are each formed on a peripheral expanse of the facing surface adjacent respective first and second electromagnets.

8. The electromechanical microswitch of claim 1, wherein the fixed portion and the sliding portion of the stripline switch element each include sapphire wear surfaces in contact with one another.

9. The electromechanical microswitch of claim 1, wherein the electrical contacts are made from a refractory metal.

10. A method for switching between first and second circuit paths using a micromechanical switch, the method comprising:

magnetically clamping a sliding waveguide circuit to a fixed waveguide circuit to make a stripline waveguide having a first circuit path when the sliding waveguide circuit is in a first activated position with respect to the fixed waveguide circuit, and a second circuit path when the sliding waveguide circuit is in a second activated position;

applying two magnetic paths to the sliding waveguide circuit; and changing a reluctance of both the magnetic paths to move the sliding waveguide circuit between the first and second activated positions.

11. The method of claim 10, further including mounting the sliding waveguide within a window defining a boundary of movement between the first and second activated positions.

12. The method of claim 11, wherein the step of defining a boundary of movement between the first and second activated positions includes:

affixing a slider window frame to a substrate on which the fixed waveguide circuit is defined to thereby expose the fixed waveguide circuit through the slider window frame; and receiving the sliding waveguide circuit within the slider window frame so that the fixed waveguide circuit is in continuous physical contact with the sliding waveguide circuit under influence of the magnetic clamping step.

13. The method of claim 10, wherein the step of magnetically clamping the sliding waveguide circuit to the fixed waveguide circuit includes:

spacing electromagnets to either side of the sliding waveguide circuit so that an electromagnetic field center of the electromagnets is located a first distance above the mounting surface; and coupling a permanent magnet to the sliding waveguide circuit and between the first and second electromagnets so that a magnetic field center of the permanent magnet is located a second distance above the mounting surface, with the second distance being greater that the first distance so that the permanent magnet is biased toward the fixed waveguide circuit.

14. The method of claim 13, further including the step of enclosing electromechanical switch within a hermetic enclosure.

15. The method of claim 13, wherein the step of changing the reluctance of both magnetic paths includes switching voltage polarities of the electromagnets to thereby reduce a magnetic resistance equivalent adjacent the first activated position and increase a magnetic resistance equivalent adjacent the second activated position so that a net magnetic force moves the permanent magnet and coupled sliding waveguide circuit to the first activated position.

16. The method of claim 15, further including switching voltage polarities a second time to thereby reduce the magnetic resistance equivalent adjacent the second activated position and increase the magnetic resistance equivalent adjacent the first activated position to create a second net magnetic force that moves the permanent magnet and coupled sliding waveguide circuit to the second activated position.

17. The method of claim 13, further including the step of de-energizing the electromagnets after the step of changing the reluctance of both magnetic paths.

18. The method of claim 17, further including the step of pulsing the electromagnets to change the reluctance of the magnetic paths a second time so that the sliding waveguide circuit is moved to another of the activated positions.

19. The method of claim 13, further including the step of maintaining power to the electromagnets after the step of changing the reluctance of the magnetic paths.

20. The method of claim 11, further including exposing the fixed waveguide circuit through the window.

* * * * *